US006199598B1

(12) United States Patent
Josefsson

(10) Patent No.: US 6,199,598 B1
(45) Date of Patent: Mar. 13, 2001

(54) MEASURING FEEDING DEVICE WITH BRAKE SHOE CLAMP

(75) Inventor: Paer Josefsson, Boras (SE)

(73) Assignee: Iro AB, Ulricehamn (SE)

( * ) Notice: Subject to any disclaimer, the term of this patent is extended or adjusted under 35 U.S.C. 154(b) by 0 days.

(21) Appl. No.: 09/367,751

(22) PCT Filed: Feb. 17, 1998

(86) PCT No.: PCT/EP98/00905

§ 371 Date: Nov. 29, 1999

§ 102(e) Date: Nov. 29, 1999

(87) PCT Pub. No.: WO98/37265

PCT Pub. Date: Aug. 27, 1998

(30) Foreign Application Priority Data

Feb. 18, 1997 (DE) ..... 197 06 288

(51) Int. Cl.[7] ..... D03D 47/36
(52) U.S. Cl. ..... 139/452; 139/194; 242/365.4
(58) Field of Search ..... 139/452, 194; 242/365.4

(56) References Cited

U.S. PATENT DOCUMENTS 3,411,548 * 11/1968 Pfarrwaller ..... 139/452
4,372,498 * 2/1983 Van Mullekom ..... 139/452
4,781,255 11/1988 Lock et al. .
5,462,096 * 10/1995 Svanstroem et al. ..... 139/452
5,660,213 * 8/1997 Tholander et al. ..... 139/452

FOREIGN PATENT DOCUMENTS 41 27 798 2/1993 (DE) .
0 250 359 12/1987 (EP) .
2 470 078 5/1981 (FR) .

* cited by examiner

*Primary Examiner*—Andy Falik
(74) *Attorney, Agent, or Firm*—Flynn, Thiel, Boutell & Tanis, P.C.

(57) ABSTRACT

A measuring feeding device for an air or water jet weaving machine having a stationary storage body for a yarn store consisting of yarn windings wound on tangentially in a predetermined winding direction, from which yarn store the yarn can be withdrawn overhead of the storage body. The device includes a stop element associated with the storage body which can be moved by means of a control unit between a stop position blocking withdrawal of the yarn and a release position allowing withdrawal of the yarn, and a yarn clamping device having a displacement drive and a brake shoe which is adjustable between a lifted position and a yarn clamping position. The braking shoe, in the yarn clamping position is positioned behind the stop element in the winding direction and is maintained in the yarn clamping position after a stroke of the stop element into the release position.

25 Claims, 2 Drawing Sheets

MEASURING FEEDING DEVICE WITH BRAKE SHOE CLAMP

This invention relates to a measuring feeding device for a jet weaving maching having a stationary storage body for storing yarn in windings, from which yarn store the yarn can be withdrawn generally overhead of the storage body.

In the measuring feeding device according to U.S. Pat. No. 4,372,498 two moveable stop elements are provided and are placed offset from one another in the axial direction of the storage body. In winding direction ahead of the circumferential position of both stop elements a brake shoe is provided which is pressed onto the windings in the yarn store when the stop element at the withdrawal side has moved into the release position. The brake shoe is affecting the yarn store in the final phase of the insertion earlier than the yarn is caught at the stop element when same is brought into its stop position. By this measure the stretching beat (whiplash effect) in the withdrawn yarn ought to be damped. At the end of the insertion the brake shoe has to be returned into its rest position to not obstruct the further forward motion of the yarn store towards the withdrawal side of the storage body.

In the measuring feeding device according to EP 0 599 930 B1 a yarn clamp is associated with the stop element. Said yarn clamp clamps against the storage body the yarn as caught by the stop element in its stop position and in the direct vicinity of the stop element. As soon as the stop element is moved back into the release position the yarn clamp also opens.

In the measuring feeding device according to U.S. Pat. No. 4,781,225, the stop element is formed by a cyclically moveable yarn clamp consisting of a pawl movably suspended in the storage body and of a stationary counterfort provided outside of the storage body.

Measuring feeding devices are used in jet weaving machines in order to measure the inserted weft yarn length by means of the stop element, because the insertion device of the jet weaving machine operating with a nozzle system is unable to precisely define the inserted weft yarn length. In case of an operation fault, e.g. a yarn breakage downstream of the measuring feeding device or within the weaving shed or caused by other reasons, at least the jet weaving machine is switched off to allow mending of the fault. During or after a switch-off-action the yarn caught at the stop element in its stop position may contain significant yarn tension. If then said yarn tension is abruptly set free, then the at least last yarn windings in the yarn store on the storage body at the withdrawal side are loosened causing the formation of free loops and entangling of the yarn at components of the measuring feeding device. Said effect is particularly disadvantageous with highly twisted yarns and is very difficult to repair. Said yarn tension may be set free for example when the stop element manually is moved from its stop position into the release position in order to be able to further draw-off yarn by hand to mend the operation fault. The tension in the yarn can also be set free if the yarn is released from a gripper (water jet weaving machine) or from an optionally provided, controlled yarn clamping, braking or tensioning device (air jet weaving machine) upstream of the insertion nozzle. Loops, entanglements, fallen off or occasionally caught windings occurring due to the relaxation of the yarn back into the yarn store on the storage body might undesirably prolong the time needed to repair the resulting operation fault.

It is an object of the invention to improve a measuring feeding device of the type as mentioned above such that operation faults of the kind as mentioned above can be repaired quickly and without excessive waste of yarn material.

The brake shoe clamps the yarn store onto the storage body in the winding direction behind the circumferential position of the stop element even after the stroke of the stop element into its release position or in case of a sudden yarn relaxation downstream of the measuring feeding device and hinders the yarn windings on the yarn store against loosening, falling off or being caught elsewhere. The yarn store remains essentially correctly in the condition which it had when the operation fault occurred. This reduces the time for repairing the operation fault. Since the brake shoe is affecting the yarn store in a clamping fashion it is at any time possible to further manually pull-off a yarn length as necessary to mend the operation fault, since the braking effect of the brake shoe can be adjusted such that the yarn can be withdrawn by hand without breaking. Furthermore, the braking effect of the brake shoe is adjusted such that, particularly during the stroke of the stop element into its release position, the tension acting in the yarn is dissipated slowly.

The yarn clamping device serves to assure a proper yarn store during and after operation faults or during the repair of operation faults, respectively. For such cases, the brake shoe can be adjusted into its yarn clamping position and can be held there. It is further possible to move the brake shoe after each insertion cycle into the yarn clamping position in order to attenuate the influence of the stretching beat (whiplash effect) of the yarn in the yarn store at the end of an insertion cycle. As a result the operational performance of the measuring feeding device can be improved for normal operation, since then the yarn store and the free yarn end both are stabilised.

The brake shoe is pressed onto the yarn store in response to actuation of the release means moving the stop element into its release position. During a subsequent movement of the stop element into its release position, e.g. for repairing an operation fault or during the abrupt relaxation of the yam, no disordered condition of the yarn store can occur. If the brake shoe is already in its yarn clamping position when the stop element moves into its release position, the brake shoe further on will be held in the yarn clamping position. In the other case the brake shoe reaches its yarn clamping position with the movement of the stop element into its release position, optionally even earlier, and will then be held in its yarn clamping position.

The brake shoe is moved each time from its rest position into the yarn clamping position, when the operation-stop-switch responds and switches off the jet weaving machine and occasionally also the measuring feeding device.

The brake shoe may be returned into its rest position by hand or by means of a control command as soon as the operation fault is repaired or where there is no further danger for the yarn store.

The brake shoe automatically is returned in the rest position if the operation fault-switch is deactivated in order to restart normal operation.

For a desired safety function that the brake shoe in its yarn clamping position acts onto a partial section of at least the last yarn winding at the withdrawal side, which partial section extends from the yarn store to the yarn stop element.

The brake shoe in its yarn clamping position is positioned a circumferential distance behind the stop element and extends in the axial direction of the storage body. The brake shoe thus brakes at least the partial section of the last winding, seen in withdrawal direction, which partial section extends from the yarn store to the stop element, but advantageously also brakes additional windings of the yarn store at the withdrawal side. Thanks to the circumferential distance between the brake shoe and the stop element a short part of the yarn between the brake shoe and the stop element remains free to move during the stroke of the stop element into its release position, while the brake shoe solely hinders a further movement of the yarn on the storage body.

The brake shoe is longer in the axial direction than in the circumferential direction and in one embodiment, the brake shoe can be configured finger-like.

In one embodiment, the brake shoe defines a yarn clamping surface having a cross-section which substantially matches with the peripheral curvature of the storage body. As such, the braked yarn is affected uniformly by the brake shoe.

The braking effect of the brake shoe ought to be adjusted such that undesired loosening of at least the last winding is avoided, however, the braking effect nevertheless should allow removal of the by hand without a danger of damage for the yarn.

The brake shoe is spring-loaded in at least one displacement direction (i.e. towards the yarn clamping position or towards the resting position) and is actuable in the opposite direction by an actuator of the displacement drive, e.g. by a solenoid or a pneumatic cylinder. Thus, a quick response behaviour of the brake shoe during its displacement into the yarn clamping position can be achieved. The return of the brake shoe into the rest position may be relatively slow, e.g., because then plenty of time is available.

The brake shoe is supported by its own holder separate from the storage body so as to restrict the already limited access to the storage body as little as possible.

The brake shoe can be supported radially adjustably at the holder. Therefore, the brake shoe can easily can be adapted to the respective selected diameter of the storage body. This is of particular advantage in case of a measuring feeding device having only one stop element and a storage body having a variable diameter.

The braking effect generated by the brake shoe is not only determined by the contact pressure but also by the choice of the yarn clamping surface.

It is intended to achieve a gentle braking for the yarn but allow removal of the yarn by hand without damage for the yarn.

Since measuring feeding devices may operate in opposite rotational directions it then is expedient, to arrange the yarn clamping device so that it can be placed in different positions (i.e. on either circumferential side of the stop element) and in the respective optimal position for a selected sense of rotation. Said possibility of different mounting locations should include the possibility to basically place the yarn clamping device optimally in relation to the stop element, i.e. closer to the stop element or further away from the stop element to align the brake shoe to a respectively desired number of yarn windings in the yarn store to be actuated by the brake shoe.

BRIEF DESCRIPTION OF THE DRAWINGS

Embodiments of the invention will be described with the help of the drawings, in which.

DETAILED DESCRIPTION

Figure 1:
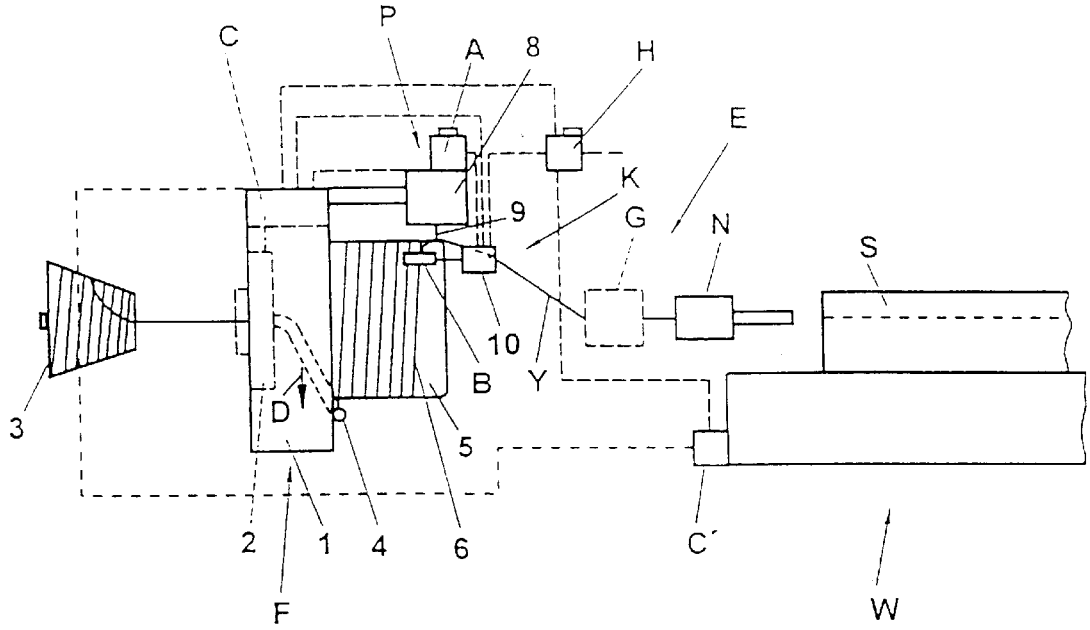
FIG. 1 is a schematic view of a yarn processing jet weaving machine having a measuring feeding device.

A yarn processing assembly E in FIG. 1 comprises a jet weaving machine W (an air jet or a water jet weaving machine) with a weaving shed S and at least one insertion nozzle N as well as a measuring feeding device F by which the weft yarn Y coming from storage bobbin 3 is fed intermittently into the jet weaving machine W. In an air jet weaving machine W a controlled yarn clamping, braking or tensioning device G can be positioned upstream of the insertion nozzle N, however, this is not strictly necessary. In a water jet weaving machine W a controlled gripper G is provided upstream of the insertion nozzle N, which gripper holds the weft yarn Y in insertion resting periods so that the weft yarn is stretched out between the measuring feeding device and the weaving machine W. In the jet weaving machine a control device C' can be provided and connected to an operation-stop switch H for switching off the jet weaving machine W in case of an operation fault. The measuring feeding device F may be connected to said switch H as well. Furthermore, frequently a connection between the control device C' of the jet weaving machine and a control device C of the measuring feeding device F can be provided to transmit, e.g. so-called trig signals, for initiating the insertion cycles.

The measuring feeding device F includes in a housing 1 a drive motor 2 for driving a winding-on element 4. Drive motor 2 is connected to control device C. Winding-on element 4 is driveable in a winding on direction D. A substantially drum-shaped storage body 5 is stationarily positioned at housing 1. By means of winding-on element 4 a yarn store 6 consisting of several wound-on adjacent yarn windings can be formed. The weft yarn Y is withdrawn overhead of storage body 5 into the jet weaving machine. A stop device P is associated with the withdrawal end of storage body 5. Within stop device P a stop element 9 is moveable in a reciprocal fashion between a stop position (FIG. 1) and a retracted release position. Said stop device P comprises a housing 8 with an actuation element for stop element 9. Housing 8 preferably is mounted to housing 1 or a housing bracket. In case that the diameter of the storage body 5 cannot be varied a plurality of stop devices P can be distributed along the circumference of the storage body 5 in order to adjust different weft yarn lengths. In case that the storage body 5 has a variable diameter a single stop device P can be used.

Part of the stop device P is a release means A which can be actuated manually or by a control command and by which the stop element 9 upon demand (in case of an operation fault) or voluntarily can be moved from its stop position into the release position.

Furthermore, a yarn clamping device K is provided including a brake shoe B which can be displaced by means of a displacement drive 10 from a rest position into a yarn clamping position against storage body 5. The brake shoe B is positioned so as to be circumferentially spaced from the position of stop element 9 in the winding direction D and extends from about the circumferential position of stop element 9 essentially in the axial direction counter to the withdrawal direction such that in the yarn clamping position of brake shoe B, at least the yarn windings at the withdrawal side of the yarn store 6 can be clamped against the storage body 5. The displacement drive 10 can be connected to control device C, release means A and the operation stop-switch H. Additionally an actuation member (not shown) for returning the brake shoe B from its yarn clamping position to the rest position can be provided.

When the stop element 9 has moved into its stop position the brake shoe B is displaced into its yarn clamping position in which it clamps or brakes the yarn windings on the storage body. During normal operation of the feeding device the brake shoe B should not be in its yarn clamping position when stop element 9 is in its release position. In case of an operation fault and in response to a fault detector (not shown) or of the operation stop switch H or in case of an actuation of the release means A, the brake shoe, however, is held in its yarn clamping position until an operation fault is repaired or until the yarn tension in the yarn between stop element 9 and gripper G or the insertion nozzle N, has been relieved gradually and to such an extent that a loosening of the yarn windings in the yarn store 6 or a falling off of windings or a loop formation can no longer occur. It may be expedient to bring the brake shoe B into its yarn clamping position after each insertion cycle and also as soon as the stop element has been brought into the stop position, in order to prevent by the braking action of the brake shoe, a back transmission of a stretching beat (whiplash effect) of the weft yarn Y into the yarn store 6 when at the end of the insertion cycle the yarn abruptly is caught at stop element 9.

Figure 2:
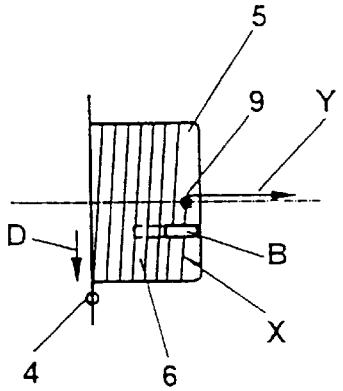
FIGS. 2 and 3 illustrate two different operation phases.
Figure 3:
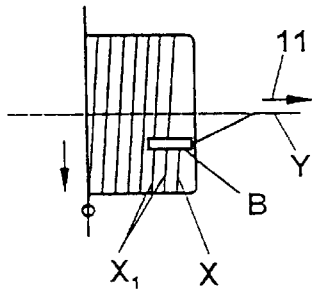

The brake shoe B extends like a finger essentially in the axial direction of the storage body 5 (FIGS. 2 and 3). In its yarn clamping position the brake shoe is clamping at least a partial section X of the last winding on the withdrawal side of the yarn store 6 against the storage body 5, which partial section extends from of the last yarn winding towards the stop element 9 which is in its stop position (FIG. 2). in case that the brake shoe B was designed longer (in FIG. 2 indicated by dotted lines) it also will clamp the adjacent yarn windings on the withdrawal side against the storage body 5.

In case of an operation stop due to a fault in the jet weaving machine or in the insertion system the weft yarn Y as caught at the stop element 9 remains under tension. If then the release means A is actuated moving the stop element 9 from its stop position into the release position for repairing said operation fault, then with the actuation of release means A or even earlier the brake shoe B is brought into its yarn clamping position in which it clamps at least the partial section X of the yarn. When stop element 9 during its movement into the release position releases the weft yarn Y the latter can only relax quickly up to the brake shoe B but cannot loosen the windings in yarn store 6 or form loops or to throw off yarn windings from the storage body 5, respectively. If any, the brake shoe B only allows a retarded relief of the tension in the yarn so that the weft yarn between the brake shoe B and the jet weaving machine W cannot get completely loose; but, the yarn windings in the yarn store 6 remain properly positioned. Said condition is indicated in FIG. 3. X1 indicates additional yarn windings on the withdrawal side onto which yarn windings the brake shoe B is acting in braking fashion. If for repairing an operation fault yarn is pulled off by hand, this has to be done counter to the braking action of the brake shoe B remaining in its yarn clamping position. Even if more yarn windings have to be pulled off by hand the yarn store 6 nevertheless remains properly positioned. When the cause of the operation fault is removed and it is to be switched back to normal operation first stop element 9 is displaced into its stop position until the weft yarn Y again is caught at stop element 9 and properly stretched towards insertion nozzle N. Prior to that condition or only then the brake shoe B is moved back into its rest position and lifted from the storage body 5. This can be carried out, e.g. when de-activating the operation stop switch H or via the control device C' or depending on an actuation of the release means A for moving the stop element 9 into its stop position, or even by means of a control command generated by control device C.

Figure 4:
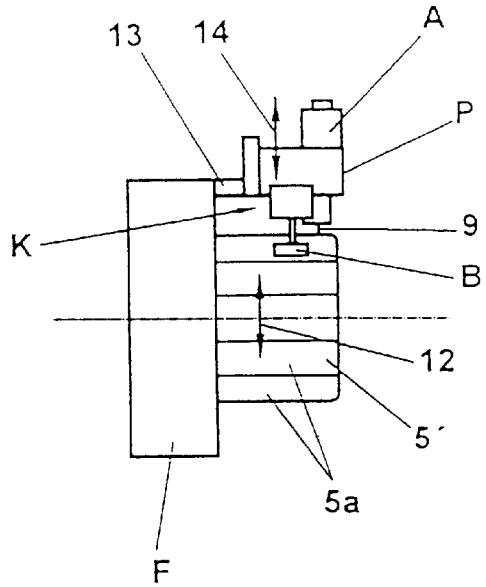
FIG. 4 illustrates a side view of a further embodiment.

FIG. 4 shows a storage body 5' which has a variable diameter and consists of several radially displaceable segments 5*a*. The yarn clamping device K is provided at the stopping device P or secured together with stop device P at a holder 13 such that the brake shoe B can be displaced in the direction of a double arrow 14 when the diameter of the storage body 5' is to be adjusted in direction of the double arrow 12. Also stop device P can be displaced correspondingly.

Figure 5:
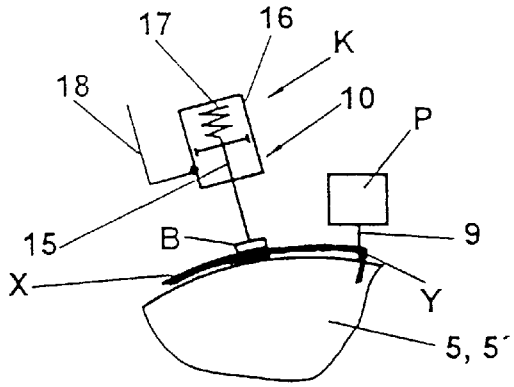
FIG. 5 illustrates a part of a further embodiment in a plan view.

In the embodiment of FIG. 5 it can been seen that the brake shoe B is connected with the displacement drive 10 of the yarn clamping device K wherein an actuating piston 15 is slideably guided in a cylinder 16. Said actuating piston 15 is moving the brake shoe B by means of a pre-tensioning spring 17 into the yarn clamping position (FIG. 5). Upon pressure actuation of cylinder 16 via line 18 brake shoe B is lifted from the storage body 5, 5' into the rest position (not shown). At least part X of the last yarn winding on the withdrawal side is secured on storage body 5, 5' by the brake shoe B. This takes place in the winding on direction behind stop device P and stop element 9.

Figure 6:
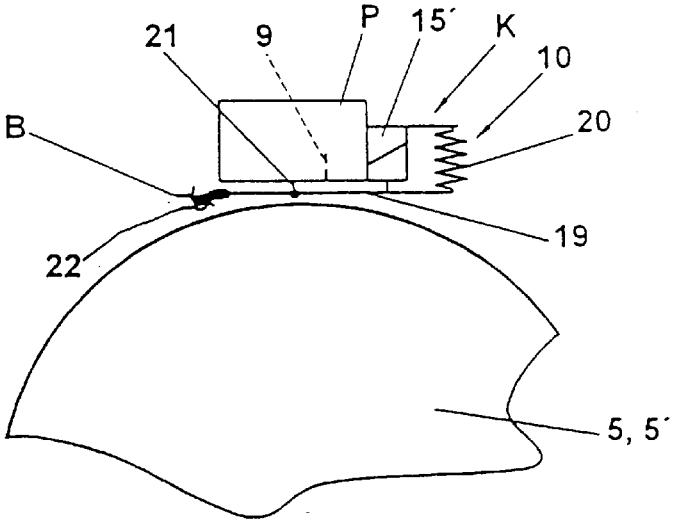
FIG. 6 illustrates a part of a further embodiment in a plan view.

In the embodiment of FIG. 6 brake shoe B is provided at an arm 19 (e.g. a leaf spring) which arm is tiltable about a suspension 21 and is actuated by a spring 20 in a direction towards the yarn clamping position. An actuator 15', e.g. a switching solenoid brings and holds the brake shoe into the rest position. Said kinematics also could be inverse. Also here the yarn clamping device is provided in the region of the stop device P and its stop element 9. However, it is possible, to provide the yarn clamping device completely separated from the stop device P.

The brake shoe B has a yarn clamping surface 22 advantageously corresponding to the curvature of the co-operating surface of the storage body 5, 5', i.e. is curved concavely, corresponding to the convex curvature of the storage body 5, 5'. Furthermore, the yarn clamping surface 22, can be made friction active, e.g. by means of bristles or a friction coating. The yarn clamping surface 22 can also have a resilient structure. The brake shoe B can be one part or can consist of several parts in order to endure a uniform contact pressure onto the yarn windings and the storage body 5, 5'.

Expediently the circumferential distance between the brake shoe and the stop element and also the axial position of the brake shoe B both can be adjusted in order to adapt the yarn clamping device K to different operation conditions and yarn qualities.

Furthermore, fixing means can be provided at the measuring feeding device F in order to put the yarn clamping device to the other circumferential side of the stop device, in case that the sense of rotation of the yarn feeding device is changed. The shown circumferential distance between brake shoe B and stop element 9 is useful in order to convert a high yarn tension in the weft yarn Y to a lower value during the movement of the stop element into its release position without abruptly pulling out the yarn from below the brake shoe.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A measuring feeding device for a jet weaving machine comprising:

a storage body for storing a yarn store defined by a plurality of yarn windings wound on said storage body in a predetermined winding direction and from which yarn is withdrawn generally overhead of said storage body from a yarn withdrawal region thereof;

at least one stop element associated with the withdrawal region of said storage body, said stop element being movable by a control device between a stop position in which said stop element blocks withdrawal of the yarn from the yarn store and a release position in which said stop element allows withdrawal of the yarn from the yarn store; and a yarn clamping device including a brake shoe and a drive which adjusts the position of said brake shoe relative to said storage body between a lifted position and a clamping position in which the brake shoe affects the yarn store at said storage body, wherein said brake shoe in said clamping position is disposed downstream of said stop element in the winding direction and is moved into said clamping position by said drive at least as early as when said stop element is moved into said release position so that said brake shoe prevents relaxation and unwinding of the plurality of yarn windings on said storage body.

2. The measuring feeding device of claim 1 including a manually actuable release device for moving said stop element into said release position, said drive being connected either directly or indirectly to said release device and upon actuation thereof said brake shoe is either held at or displaced into said clamping position and maintained thereat.

3. The measuring feeding device of claim 1 including a switch for stopping operation of at least said measuring feeding device upon detection of an operation fault, and said drive displacing said brake shoe into said clamping position in response to activation of said switch which stops operation of at least said measuring feeding device.

4. The measuring feeding device of claim 3 wherein said drive is directly or indirectly connected to said switch such that in the event of deactivation of said switch said brake shoe is displaced from said clamping position into said lifted position.

5. The measuring feeding device of claim 1 including an actuating member for moving said brake shoe from said clamping position to said lifted position.

6. The measuring feeding device of claim 1 wherein said storage body defines an axis and said brake shoe in said clamping position is disposed circumferentially closely adjacent said stop element and downstream thereof in the winding direction, said brake shoe extending axially from approximately the axial location of said stop element in a direction opposite to a yarn withdrawal direction so as to clampingly engage a plurality of windings of the yarn store at said withdrawal region of said storage body.

7. The measuring feeding device of claim 1 wherein said storage body defines an axis and said brake shoe has an axial dimension which is greater than a circumferential dimension thereof.

8. The measuring feeding device of claim 6 wherein said storage body defines an axis and said brake shoe has the shape of an axially extending finger which defines thereon a yarn clamping surface disposed to face a periphery of said storage body.

9. The measuring feeding device of claim 8 wherein said yarn clamping surface has a contour which substantially follows a curvature of said periphery of said storage body.

10. The measuring feeding device of claim 1 wherein said brake shoe is spring-loaded so as to be urged into one of said clamping position and said lifted position and is displaceable into the other said position by an actuator of said drive, said actuator comprising one of a solenoid and a pneumatic cylinder.

11. The measuring feeding device of claim 1 including a holder for supporting said brake shoe, said holder being structurally separate from said storage body.

12. The measuring feeding device of claim 11 wherein said storage body is configured so as to be variable in diameter, and said brake shoe is supported by said holder adjacent said stop element and is radially adjustable relative to said storage body.

13. The measuring feeding device of claim 1 wherein said brake shoe defines thereon a yarn clamping surface which faces a periphery of said storage body, said yarn clamping surface being configured to be one of friction-active and resilient.

14. The measuring feeding device of claim 1 wherein said storage body defines a circumference and said device includes means for selectively mounting said yarn clamping device at either circumferential side of said stop element in relation to the circumference of said storage body depending upon a rotational direction of a yarn winding element.

15. The measuring feeding device of claim 1 wherein said storage body is generally cylindrically-shaped and defines an axis and a peripheral surface which extends circumferentially about said storage body, and the yarn store is defined by a continuous length of yarn which is wound about said circumference in said winding direction to form the plurality of yarn windings which are disposed between one end of said storage body adjacent a winding element and an opposite end thereof, said opposite end of said storage body defining said withdrawal region of said storage body, said stop element is positioned adjacent said opposite end so as to block the last of the yarn windings just prior to when same is fed into the weaving machine, and with respect to said winding direction, said brake shoe is disposed downstream of said stop element such that the last yarn winding relaxes to the location of said brake shoe when said stop element is moved into said release position.

16. The measuring feeding device of claim 15 including a release device for moving said stop element into said release position, said drive being connected to said release device so as to displace said brake shoe into said clamping position or hold said brake shoe in said clamping position upon movement of said stop element into said release position.

17. The measuring feeding device of claim 16 wherein said brake shoe has an axially elongate shape such that same clampingly engages a plurality of windings of the yarn store.

18. The measuring feeding device of claim 17 including a switch for stopping operation of at least said measuring feeding device, and said drive displaces said brake shoe into said clamping position in response to activation of said switch to stop operation of at least said measuring feeding device, said drive being connected to said switch such that in the event of deactivation of said switch said brake shoe is displaced from said clamping position into said lifted position.

19. The measuring feeding device of claim 18 wherein said brake shoe defines thereon a yarn clamping surface which faces said peripheral surface of said storage body, said clamping surface having a generally concave curvature so as to substantially conform to a generally convex curvature of said peripheral surface of said storage body.

20. The measuring feeding device of claim 1 wherein said brake shoe is moved into said clamping position by said drive prior to movement of said stop element into said release position and is held in said clamping position thereafter.

21. The measuring feeding device of claim 1 wherein said storage body defines an axis and an outer circumferential surface about the axis, said brake shoe is disposed circumferentially closely adjacent said stop element and at substantially the same axial position of said stop element along said storage body such that said brake shoe in said clamping position acts on a leading portion of the last winding of the yarn store which is disposed most closely adjacent the weaving machine at the withdrawal region of said storage body.

22. The measuring feeding device of claim 21 wherein said brake shoe is disposed within a first quarter of said circumferential surface of said storage body, said first quarter beginning at said stop element and extending in the winding direction along said storage body.

23. The measuring feeding device of claim 1 wherein said control device moves said stop element into said release position in response to detection of an operation fault wherein at least operation of said measuring feeding device is stopped, said drive moving said shoe into said clamping position at least as early as when said stop element is moved into said release position to prevent relaxation and unwinding of the plurality of yarn windings on said storage body during repair of the operation fault.

24. A yarn feeding device for a weaving machine, said device comprising:

a storage body for storing a yarn storage unit defined by a plurality of yarn windings wound about said storage body in a predetermined winding direction by a winding element, said storage body having a yarn withdrawal area disposed adjacent the weaving machine from which yarn withdrawal area the yarn storage unit is withdrawn;

a stop element disposed adjacent the withdrawal area of said storage body and an actuator which moves said stop element in a reciprocating manner between a stop position to block withdrawal of the yarn storage unit from said storage body and a release position to permit removal of yarn from the yarn storage unit on said storage body during repair of a fault condition; and a brake disposed downstream of said stop element in the winding direction and a drive which displaces said brake into a clamping position so as to act on at least the last winding of the yarn store disposed most closely adjacent the weaving machine, said drive displacing said brake into said clamping position at least as early as when said actuator moves said stop element into said release position such that when said stop element is released, the last winding relaxes only to the location of said brake and the yarn storage unit remains properly positioned on said storage body during repair of the fault condition.

25. The feeding device of claim 24 wherein said brake is disposed downstream of said stop element circumferentially closely adjacent thereto, said storage body defining an axis and an elongate cylindrical shape, said winding element and said storage body being relatively rotatable with respect to one another to effectively wind the plurality of yarn windings about id storage body and define the yarn storage unit.

* * * * *